US005681210A

United States Patent [19]

Lin et al.

[11] Patent Number: 5,681,210

[45] Date of Patent: Oct. 28, 1997

[54] HONING TOOL FOR ELLIPTICAL CYLINDER BORE

[75] Inventors: Yhu-Tin Lin, Rochester Hills; Eberhard Ernst Wasserbaech, Shelby Township, Macomb County; Antoni Joseph Malarz, Troy, all of Mich.

[73] Assignee: General Motors Corporation, Detroit, Mich.

[21] Appl. No.: 659,052

[22] Filed: Jun. 3, 1996

[51] Int. Cl.[6] ..... B24B 7/00; B24B 9/00

[52] U.S. Cl. ..... 451/157; 451/155

[58] Field of Search ..... 451/157, 61, 51, 451/23, 155; 408/158; 409/143, 200; 74/57

[56] References Cited

U.S. PATENT DOCUMENTS

| | | | |
|---|---|---|---|
| 1,793,486 | 2/1931 | Hunt | 451/155 |
| 2,111,784 | 3/1938 | Johnson | 451/155 |
| 2,195,052 | 3/1940 | Wallace | 451/155 |
| 2,195,060 | 3/1940 | Wallace et al. | 451/155 |
| 2,751,800 | 6/1956 | Beach | 77/61 |
| 2,819,566 | 1/1958 | Johnson | 451/155 |
| 2,870,577 | 1/1959 | Seborg | 451/155 |
| 3,352,067 | 11/1967 | Estabrook | 451/155 |
| 3,393,472 | 7/1968 | Sunnen | 451/155 |
| 4,557,640 | 12/1985 | Rottler | 451/155 |
| 4,621,455 | 11/1986 | Sunnen et al. | 451/155 |
| 4,834,033 | 5/1989 | Larson | 74/57 |
| 4,945,685 | 8/1990 | Kajitani et al. | 451/155 |
| 5,078,021 | 1/1992 | Freywiss | 74/57 |
| 5,201,618 | 4/1993 | Malarz et al. | 409/132 |
| 5,318,603 | 6/1994 | Scheider et al. | 51/293 |
| 5,525,099 | 6/1996 | Baird et al. | 451/157 |

*Primary Examiner*—James G. Smith
*Assistant Examiner*—Derris H. Banks
*Attorney, Agent, or Firm*—Patrick M. Griffin

[57] ABSTRACT

A honing tool for elliptical bores uses a unique rotary to linear to radial translation mechanism to translate the primary rotary motion of the drive shaft into axial motion of rods and sleeves within the drive shaft, which ultimately wedge the honing stones out, and pull them rigorously back in, in the desired elliptical pattern, with no loss of bore accuracy. A cam sleeve rotating with the drive shaft has undulating cam grooves that push and pull a pair of cam followers together and apart with every quarter turn. The cam followers shift a rod and sleeve up and down to wedge the honing stones in and out. The shape of the cam groove and the angle of the wedges are predetermined so as to create the proper elliptical pattern.

3 Claims, 7 Drawing Sheets

HONING TOOL FOR ELLIPTICAL CYLINDER BORE

This invention relates to honing tools for cylinder bores in general, and specifically to an apparatus for honing a cylinder bore of elliptical cross section.

BACKGROUND OF THE INVENTION

The most common cylinder bore (and piston) shape by far is the simple cylinder, with a circular cross section, as taken perpendicular to the bore's central axis. The prevalence of the circular shape has more to do with its ease of manufacture than with any inherent operational efficiency. Circular shapes are easier to rough bore and finish, or, as it is known, hone. Honing the surface, ideally, brings the rough machined surface to a final shape tolerance, smoothes out jagged cutting marks, and, in addition, leaves a finely cross hatched surface that is conducive to oil film retention.

Recently, there has been some movement toward cylinder bores that are elliptical in cross section. These have the great advantage of packaging more effective bore volume within the total potential volume available in a given engine block. This is because the elliptical shape leaves thinner webs between the bores. The downside is that there has historically not been an accurate, practical apparatus and method available either for rough machining or honing a cylinder bore of elliptical shape. For example, U.S. Pat. No. 2,751,800 discloses a single cutting point that swings around on an eccentric to track and cut an elliptical shape. However, such an apparatus has a large number of joints that can potentially slip and jeopardize accuracy, nor is it particularly axially stiff. A relatively recent co assigned patent, U.S. Pat. No. 5,201,618 to Malarz et al, does provide an accurate, robust, and fast boring tool for rough cutting an elliptical shape. A circular cutting disk with conventional cutting inserts attached to its periphery is supported in an active orientation that is tipped from the vertical, thereby presenting an elliptical profile that cuts a correspondingly shaped bore. This machines the surface as finely as a cutting insert can, but still leaves rough ridges in the surface that need final honing and smoothing.

An understanding of how a conventional, circular bore hone works illustrates the inherent problem in honing an elliptical bore. U.S. Pat. No. 5,318,603 describes the workings of a typical honing tool. As seen in its FIG. 1, a generally cylindrical tool body 24 retains a set of evenly spaced stone holders 33, each of which has a honing stone fixed to in. An expander 32 that includes two aligned shallow angle cones has the stone holders 33 held slidably against it by surrounding garter springs 34. The cone expander 33 is fixed to an inner central rod that slides axially within a hollow, rotating drive shaft. The drive shaft and inner rod rotate one to one, keeping the honing stones at a fixed common radius to finish the inner surface of the bore. At the same time, the outer shaft and inner rod stroke axially up and down together, thereby giving the distinctive cross hatched pattern to the inner surface. While the inner rod does not twist or turn within the outer shaft, it is designed to move slightly axially within it, for two purposes. One purpose is to retract the stones initially to get them into the bore, and to then expand them out to the proper radius. The other purpose is for stock removal, that is, the inner rod is pushed very slowly, and very slightly, within the hollow drive shaft during the honing process to slowly increase the effective radius at which the stones work, and thereby assure that all rough ridges left by the initial cutting process are removed.

It should be kept in mind that the radial motion imparted to the stones by the expander 33 dating the honing process is a slow, almost static process. The patent inartfully describes this motion as "reciprocation," but the stones are not designed to shift radially back and forth dynamically or regularly. There would be no reason for them to do so, since they basically operate at a fixed radius, at any point in time. Moreover, a rapid, back and forth acceleration of the stone holders 33 could not be handled by the garter springs 34, which would allow lag or lost motion as the stones rapidly retracted.

The situation is very different when the task of honing an elliptical bore is faced. Now, the stones cannot sit at a fixed radius as the tool holder rapidly spins. They must continually, dynamically change radius, truly reciprocating back and forth from the smaller to the larger dimension of the elliptical cross section, four times with each rotation. The only existing tool known for honing an elliptical bore is a passive, form following tool. That is, the honing stones wipe along and follow the inner surface of the bore, like a needle on a record, positioning themselves only with the accuracy that the bore cross section has already. Individual hydraulic cylinders push outwardly on four swing arms to which the stones are fixed. The hydraulic cylinders push the stones out with a continual pressure, but are not directly attached thereto, relying on springs to retract the swing arms back in. As such, the profile cut by the stones can only get worse as they progressively remove metal, since they have no inherent mechanism to truly, rigorously keep them on track. Representations of the tool working actually shown the cross section of the bore as having a series of flats cut into it, in an apparent recognition of the problem.

SUMMARY OF THE INVENTION

The invention provides a new apparatus for honing an elliptical cylinder bore which actively and accurately creates the desired elliptical shape, rather than just passively following, and worsening, the existing profile. In addition, it works in conjunction with a conventional honing machine, and preserves the ability of a conventional tool both to retract and expand the honing stones at the beginning of the cycle, as well as to steadily radially expand all of the stones simultaneously during the cycle for stock removal.

The new apparatus of the invention is designed to be used with a conventional honing machine, which includes a powered spindle capable of rotation and axial stroking. Axially slidable within the spindle is a stub shaft, which is capable of precise, incremental expansion relative to and within the spindle, even while the spindle is itself is axially stroking. The stub shaft is conventionally used for initial stone retraction and expansion at the start of the cycle, and for progressive stock removal during the cycle. In the apparatus of the invention, these features of the conventional honing machine are used to provide the same function, but indirectly, through a unique mechanism.

In the preferred embodiment disclosed, the upper end of a hollow drive shaft is fixed to the honing machine spindle, so as to be rotated and axially stroked. A generally cylindrical stone guide is fixed to the bottom of the drive shaft, and experiences the same basic rotation and stroking. The honing stones, however, rather than riding at a fixed radius, receive a precise and rapid radial expansion and contraction superimposed onto the basic rotation, which actively forms, rather than just passively following, the desired elliptical shape. This expansion and contraction is imparted to two diametrically opposed pairs of stones, with the stones of one pair expanding away from each other as the other is retracting toward one another, and vice versa.

Two cooperating mechanisms create the proper motion, a guide mechanism that allows the stones to expand and contract radially and guides them as they do so, and a translation mechanism that causes the stones to move over the proper elliptical pattern. The honing stones are each guided in their radial motion by being fixed to the outer edge of a stone carrier, which can slide radially back and forth through one of four evenly spaced guide slots in the stone guide, but are rotationally and axially constrained. The inner edge of each stone carrier has a pair of equal angle ramps thereon, which are outwardly sloped. Radially inboard of the four stone carriers are four evenly spaced wedging members, each of which consists of an inwardly directed pair of ramps equal in angle to, and slidably engaged with, the outwardly directed ramps of a respective stone carrier. One diametrically opposed pair of wedging members is formed on a notched central core which can slide up and down axially within the stone guide, but is rotationally and radially constrained. The other diametrically opposed pair of wedging members are formed on a pair of semi cylinders that slide up and down axially within the stone guide and within the central core's notches. When either pair of wedging members are pushed down, their respective stone carriers are pushed radially out to a degree determined by the angle of the ramps, while the other pair is simultaneously pulled radially in. The mechanism that pulls the stone carriers in are roll pins that slide closely in slots that parallel the ramps. Therefore, when either pair of wedging members are pulled up, their respective stones are pulled inwardly with a high degree of accuracy, and with no lost motion or lag, as with garter springs.

The stone carriers and stones are moved over the desired elliptical pattern by linear translation mechanisms that translate the rotational motion of the drive shaft into the proper degree of axial motion of each pair of wedging members and, ultimately, into radial motion of the stone carriers and stones. The prime mover of the translation mechanism is a cam sleeve that surrounds the drive shaft. The cam sleeve rotates one to one with the drive shaft and, at any point in time, is effectively axially fixed relative to the drive shaft. Upper and lower undulating grooves cut into the outer surface of the cam sleeve each have a constant radius, but an axial height that increases and then decreases every ninety degrees. In addition, the axial sense of the grooves is opposed. That is, when the upper cam groove is descending from its greatest heights, the lower cam groove is ascending from its greatest depth, and vice versa. The incremental amount of each groove's rise or ascent, per degree of rotation, is determined such that the corresponding increment of radial retraction or extension that the wedging members impart to the stone carriers moves the stones over the desired elliptical pattern. Each cam groove, in turn, has an axially guided, roller driven cam follower that rides up or down with it, matching it's axial motion. The cam followers are pulled relatively together, then pushed apart, changing direction every ninety degrees, an axial oscillation motion that is superimposed on the basic stroking motion of the drive shaft.

The axial oscillation of the upper cam follower is translated to the pair of wedging members formed on the central core by a central push rod that slides within the drive shaft. The central rod is pinned to an upper bearing sleeve that rides on a ball bearing fixed to the upper cam follower. The axial oscillation of the lower cam follower is translated to the other pair of wedging members (those formed on the semi cylinders) by a lower push sleeve that slides within the drive shaft (and over the central push rod). The lower push sleeve is pinned to a lower bearing sleeve that rides on a bearing fixed to the lower cam follower. Clearance slots in the drive shaft allow the pins to move axially. In conclusion, as the shaft rotates and strokes, and as the cam sleeve co rotates, the cam followers oscillate toward and away from each other in a superimposed axial motion that, in turn, creates a radial retraction and expansion of the stones. In effect, the stones sweep out two orthogonal radius vectors, one of which is always expanding as the other is contracting. The four end points of the vectors, where the active surfaces of the stones are located, actively track the exact elliptical shape desired, rather than just passively wiping along a pre existing shape, so that no bore accuracy is lost. In addition, in the embodiment disclosed, the stub shaft of the honing machine spindle is able to slowly slide the cam sleeve over the drive shaft, both at the start of the honing cycle and during it, even though the cam sleeve is basically axially fixed on the drive shaft at any point in time during the cycle. By moving the cam sleeve relatively up or down, the cam followers can be both pulled up or both pushed down at once, so that all four stones can be simultaneously retracted or extended. This gives the stone retraction and expansion that is needed at the start of the cycle. It also allows the cam sleeve and to be steadily and slowly pushed down during the cycle, so that the stones will all be proportionally steadily and slowly expanded, for stock removal. Therefore, none of the operational advantages of a conventional, round bore honing machine are lost.

DESCRIPTION OF THE PREFERRED EMBODIMENT

These and other feature of the invention will appear from the following written description, in which.

Figure 1:
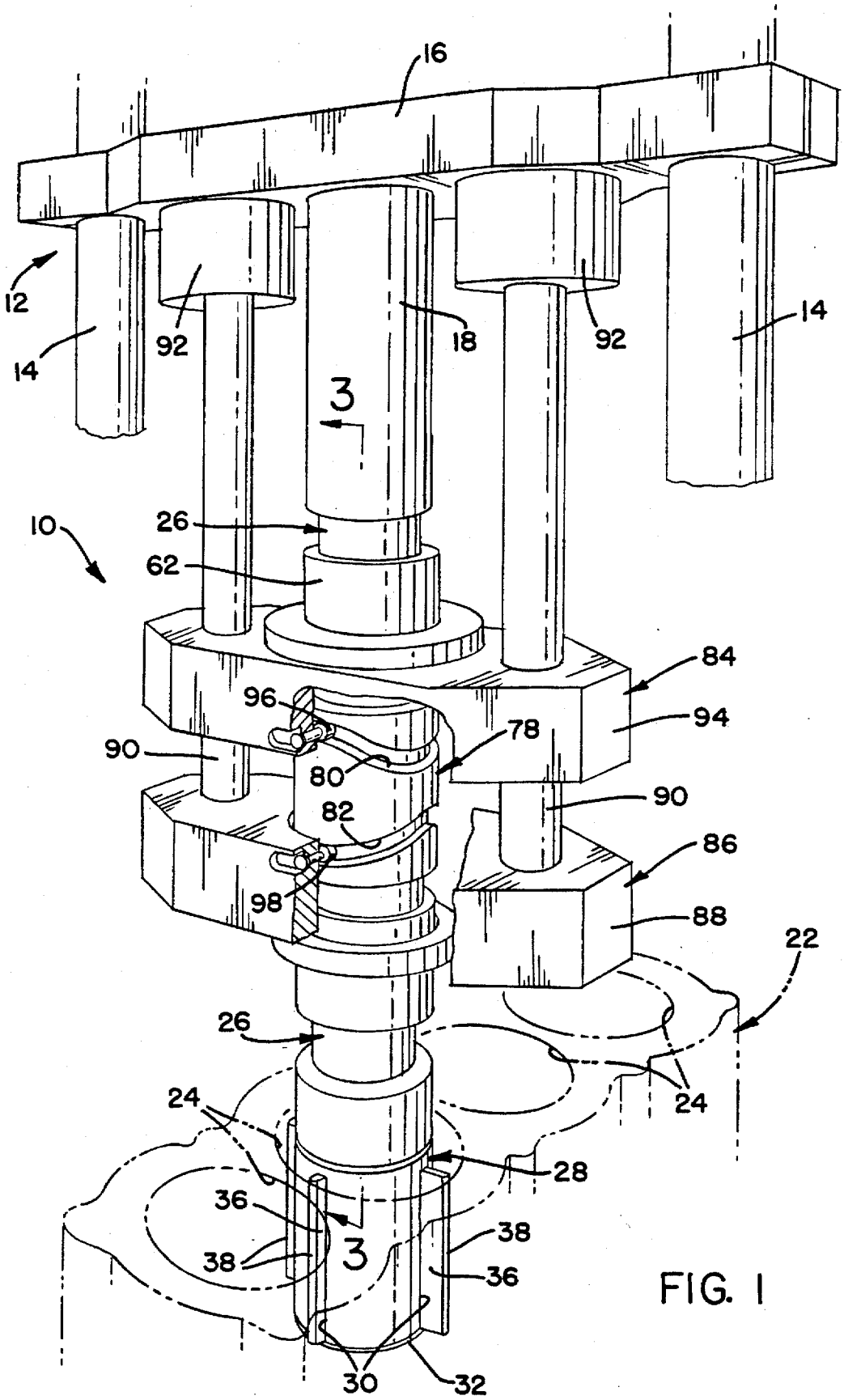
FIG. 1 is a perspective view of a honing machine incorporating the apparatus of the invention, with the cam followers pulled apart to their maximum separation, and showing a cylinder block in dotted lines.
Figure 3:
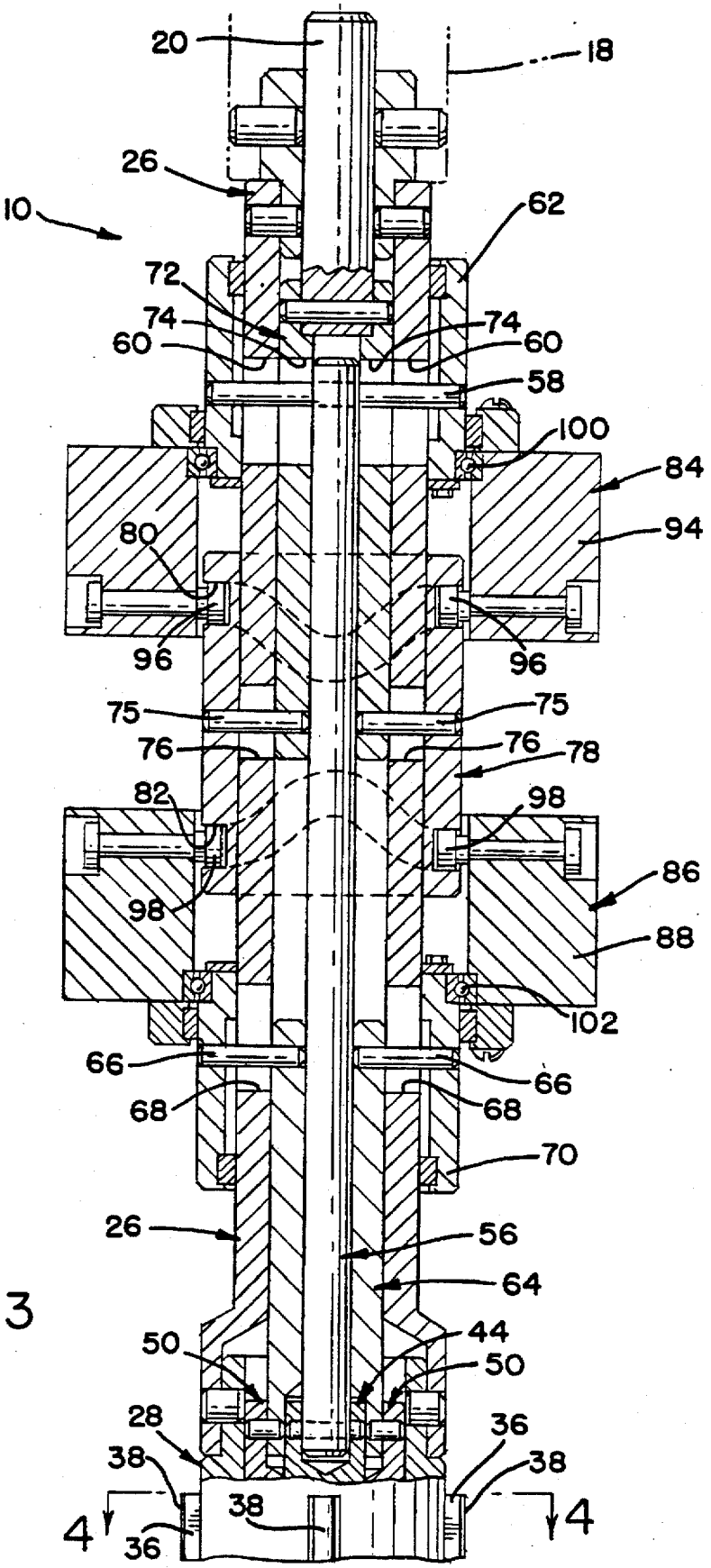
FIG. 3 is a sectional view taken along the line 3—3 of FIG. 1.
Figure 5:
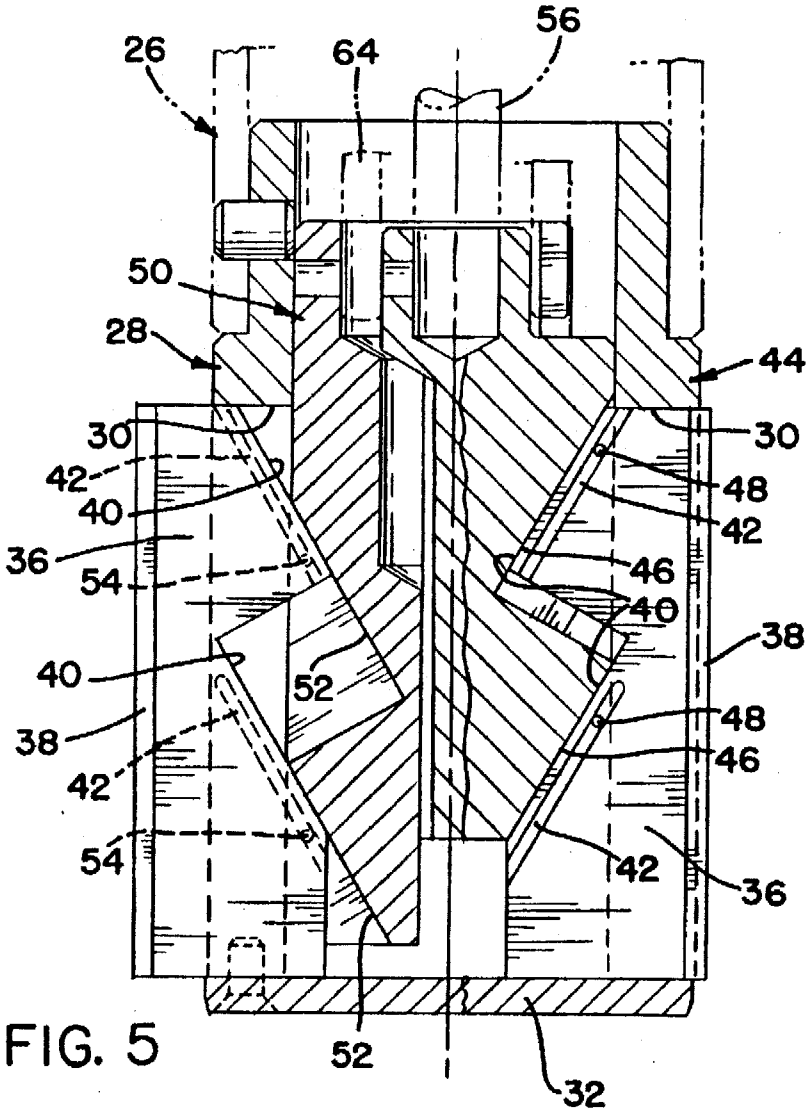
FIG. 5 is a sectional view taken along the line 5—5 of FIG. 4.

Referring first to FIGS. 1 and 3, a preferred embodiment of the honing apparatus of the invention, indicated generally at 10, is used with a conventional honing machine, indicated generally at 12, which is a type well known to those skilled in the art. Machine 12 is the same machine used to hone round bores, and the invention adds a complex new mechanism on to the machine 12 in order to hone an elliptical bore. The new, added mechanism does not interfere with its standard operation or functions, however. Machine 12 has a rigid supporting framework consisting of a pair of depending bracing rods 14 and a rigid cross brace 16 clamped perpendicularly across their lower ends. Cross brace 16 provides a bearing support for the end of a powered, rotating spindle 18, which is rotated at about two hundred to two hundred and fifty RPM. Simultaneously with its rotation, machine 12 axially strokes spindle 18 up and down over whatever stroke length is needed for the particular length of bore being honed, generally about five to six inches, and at about sixty to seventy cycles per minute. A typical honing cycle lasts one half to a full minute. Located centrally within spindle 18, which is hollow, is a stub shaft 20, which is capable of being slowly, accurately, and steadily axially advanced within and relative to spindle 18 during the honing cycle. The stub shaft 20 is typically driven by a precisely controllable servo motor or the like, which is itself part of the spindle 18 and moves with it. Therefore, stub shaft 20 also rotates and strokes up and down with spindle 18, even though it is concurrently advanced slightly axially relative to it. The extra axial motion of the stub shaft 20 is used, when honing a round bore, to achieve the two purposes noted above. At the start of the honing cycle, the stub shaft 20 is pulled up to retract the stones in, allowing them to be inserted freely down into the bore, after which the stub shaft 20 is pushed down to expand the stones radially back out against the surface of the bore. Then, during the honing cycle, the stub shaft 20 is steadily and slightly advanced far enough to create a proportionate radial expansion of the honing stones for stock removal. Typically, stub shaft 20 would move only far enough, during the honing cycle, to cause the honing stones to expand enough to in turn take off only about one thousandth of an inch from the inner surface of bore 24. Stub shaft 20 does basically the same thing in the subject invention, but does so indirectly, through the medium of the same complex mechanism that allows the elliptical shape to be honed.

Figure 10:
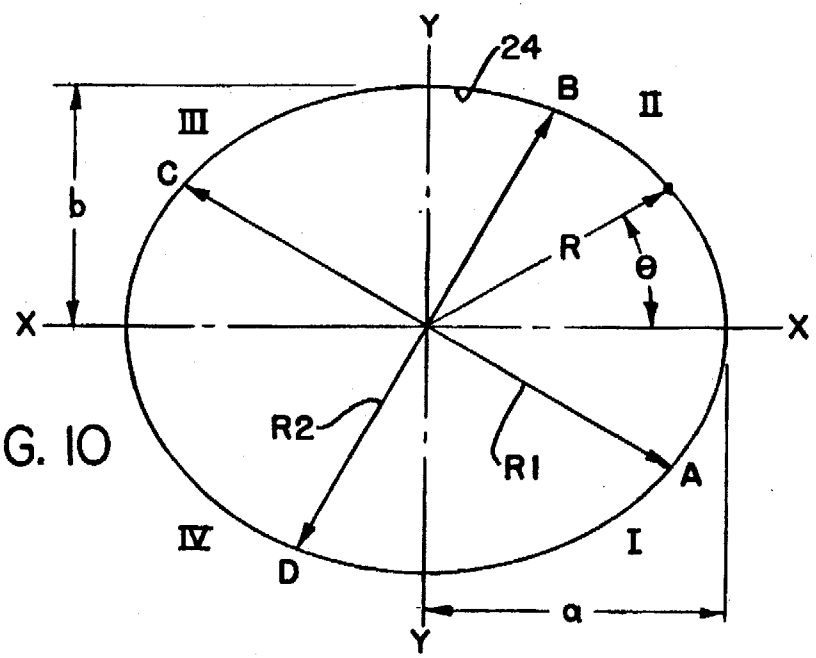
FIG. 10 is a schematic representation of the cross section of the bore superimposed on an x-y reference frame.

Referring next to FIGS. 1 and 10, the nature and shape of the bore to be machined are more fully explained. An engine block 22 has a series of elliptical bores 24 therein, each of which would be initially cast at a near net shape. The surface of each bore 24 would next be rough machined with the cutting tool referred to above, leaving the inner surface of the bore 24 accurately cut, but with inevitable surface irregularities that require honing. This is true of round bores as well, of course, but the conventional honing tools used for round bores would be totally incapable of honing the elliptical shape. The theoretical challenge involved in honing an elliptical shape can be better understood from FIG. 10, which shows a cross section of the inner surface of a bore 24 taken normal to its central axis. To provide an analytical reference frame, an x-y axis is drawn through an origin lying on the central axis of bore 24, with the length of the ellipse lying on the x axis, which is a common convention for drawing an ellipse. This divides the ellipse into four quadrants, labeled I–IV, with the shorter axis "b", the so called "semi minor" axis, lying on the y axis, and the longer or "semi major" axis "a" lying on the x axis. The standard formula for an ellipse depicted on such a reference frame is the familiar $x^2/a^2+y^2/b^2=1$.

Any point on the ellipse can be described mathematically as a point with a radius of length R (measured from the origin) and an angle theta, measured from the 3 o'clock line. The x and y coordinate of any point can be represented as $x=R\cos\theta$ and $y=R\sin\theta$, so the length of R can therefore be represented in terms of a, b, $\cos\theta$, and $\sin\theta$, working through the Pythagorean theorem, as $R=1/[(\cos^2\theta/a^2+\sin^2\theta/b^2)]^{1/2}$.

Therefore, knowing a and b, then the length change in R necessary to track the ellipse, at every chosen increment of $\theta$, can be calculated. The starting point for the reference angle $\theta$ is arbitrary, although the 3 o'clock line is convenient, and the increment in angle to be used would be chosen small enough to smoothly track the ellipse, approximately one or two degrees, for example. If, in turn, some mechanism can be devised to actually cause that exact length change in R at each angular increment of rotation, then a honing stone whose active surface resides at R will accurately track the same surface. Given the practical considerations in honing a bore, the more useful way to visualize the situation is as two perpendicular radius vectors, indicated at R1 and R2 in FIG. 10, the ends of which sweep along diagonally opposed quadrants of the ellipse simultaneously. Thus, one radius vector R1 is always contracting as the other is expanding, and vice versa, from a shortest length of *2b* to a longest length of *2a* and back. What is practically needed is a mechanism that will simultaneously expand and contract at least four evenly spaced honing stones in the same fashion, that is, in two diametrically opposed pairs, since that will provide a better balanced and faster acting tool. The complex mechanism described in detail below does so.

Figure 2:
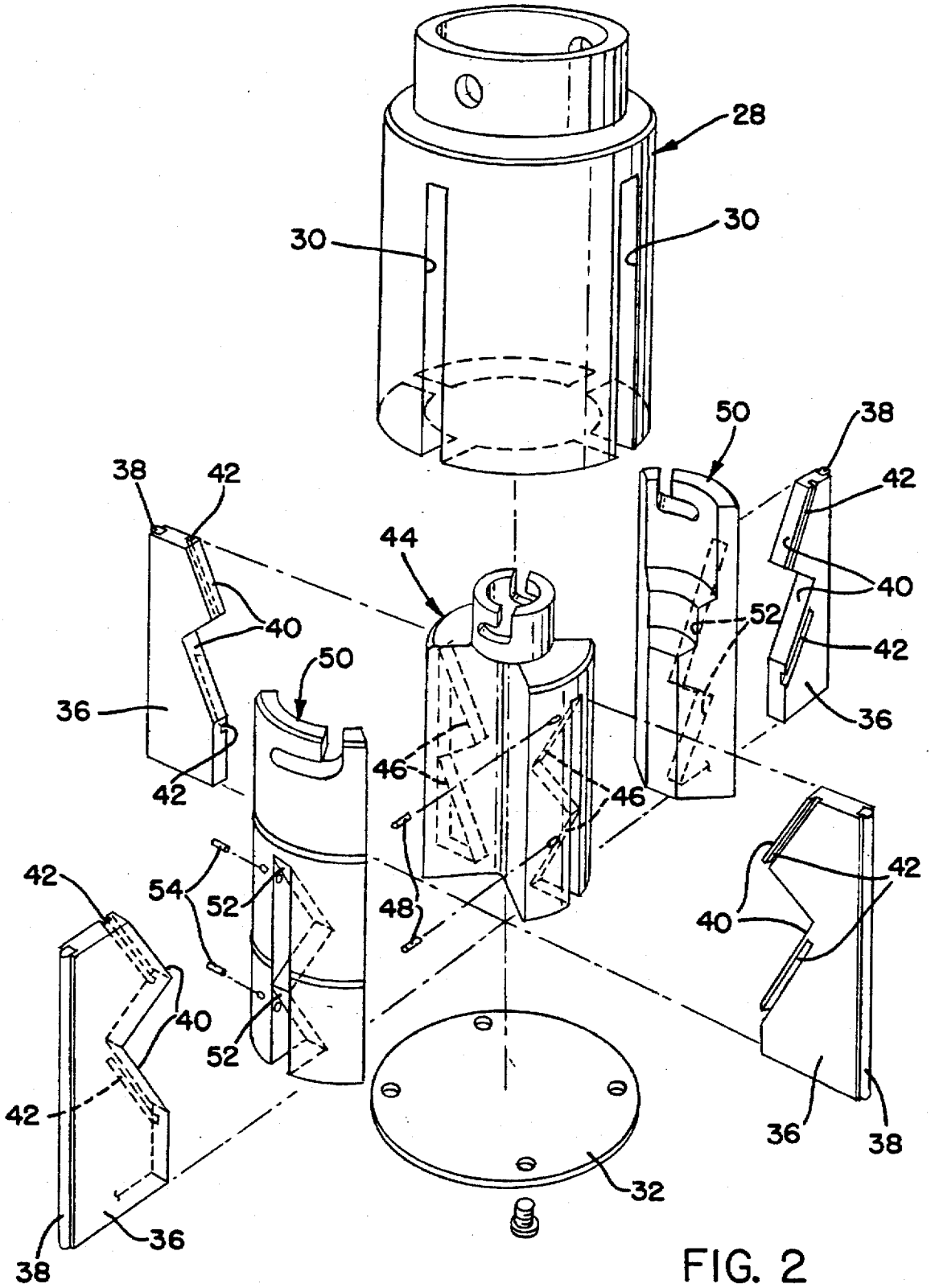
FIG. 2 is an exploded perspective view of the tool guide.

Referring next to FIGS. 1, 2 and 3, the complex series of mechanisms that cooperate to create the desired end result will be described by starting at the lower end, where the apparatus meets the surface of the bore 24, and working back up to the machine spindle 18. First, however, it is useful to at least generally describe the component that provides the reference frame for all other components, and the structural foundation for many of them. A central drive shaft 26 comprises a hollow cylinder, pinned at the top to the honing machine spindle 18, so as to be rotated and axially stroked thereby. Shaft 26 transfers rotation and axial motion to the other components, and its central axis is the axis about which other components rotate, and relative to which they move axially and radially. Shaft 26 also provides the guide within which other components slide axially, as will appear below. The mechanism which allows and guides the desired radial motion of the four honing stones is a stone guide, indicated generally at 28, which is pinned to the lowermost end of drive shaft 26. Stone guide 28 is a hollow steel cylinder with four evenly spaced guide slots 30 cut through it's outer wall and a removable bottom plate 32 closing its lower end. The guide slots 30 are all at a common radius, relative to the central axis of drive shaft 26, and parallel thereto. Closely received within each guide slot 30 is one of four equal size and shape honing stone carriers 36, each of which is thereby constrained against rotational or axial motion relative to the guide 28, but is able to slide radially back and forth through the slot 30, sliding along, and axially confined by, the bottom plate 32. The exposed outer edge of each stone carrier 36 retains a conventional honing stone 38, while the inner edge is machined into a pair of inwardly directed ramps 40, each with an angle of thirty degrees, as measured relative to the central axis. Each ramp 40 is closely paralleled on one side by a narrow pin slot 42.

Still referring to FIGS. 1, 2 and 3, the rigid attachment of stone guide 28 to drive shaft 26, coupled the close capture of the stone carriers 36 within the stone guide slots 30, assures that the honing stones 38 will rotate and move axially with shaft 26, at whatever radius they happen to have at any point in time. That radius, in turn, is determined by the axial position of other structure within, and relative to, stone guide 28. Inside stone guide 28 is a solid steel central core 44, the outer surface of which slides closely within the inner surface of guide 28, but with a significant axial clearance from the top of guide 28. Core 44 has two opposed quarter sections cut out of it. The other two quarter sections are slotted so as to closely slidably receive two stone carriers 36. Cut into the inner edges of the slots of core 44 are a pair of outwardly directed ramps 46, equal in angle to and slidably abutted with a respective pair of stone carrier ramps 40. After a stone carrier 36 has been fitted into the slotted side of core 44, a pair of roll pins 48 are inserted tightly through the body of core 44 until their ends stick perpendicularly into the pin slots 42. This is done for both of the stone carriers 36 that are operated by core 44, though just the one pair of roll pins 48 is illustrated. This slidably captures two of the stone carriers 36 to the core 44 in a rigorous fashion, that is, in such a way that the two sets of ramps 46 and 40 are forced to slidably abut with negligible lag or lost motion. Also within the interior of stone guide 28 are a pair of semi cylinders 50, the outer surfaces of which also fit closely within the inner surface of the stone guide 28, and the inner surfaces of which fit closely within the side notches of the core 44, with a comparable axial length. Just as with the core 44, the semi cylinders 50 are slotted to closely slidably receive the other two stone carriers 36, with a pair of outwardly directed ramps 52 that match the stone carrier ramps 40 in size and slope. As with the core 44, when the remaining two stone carriers 36 are inserted and the respective ramps 52 and 40 are abutted, the same size roll pins 54 are inserted through both of the semi cylinders 50 and into the pin slots 42 of the two stone carriers 36 that are operated by the semi cylinders 50.

Referring next to FIGS. 1, 2, 3 and 5, when the stone carriers 36 have all been assembled to the core 44 and to the semi-cylinders 50 as just described, they are fitted together and slid into the open lower end of the stone guide 28, as the stone carriers 36 slide through and into the guide slots 30. Then, the bottom plate 32 is bolted in place. Now, independent axial sliding motion of either the core 44 or the semi cylinders 50 within guide 28 is possible, up or down, because of the axial clearance described. When the core 44 is pushed down, the sliding inter engagement of the stone carrier ramps 40 against the core ramps 46 wedges one diametrically opposed pair of stone carriers 36 simultaneous and equally radially out through the guide slots 30. The stone carriers 36 are axially confined by the plate 32, and are both rotationally confined and radially guided by the slots 30. The ratio or proportion at which axial downward motion of the core 44 is translated into radial extension of the stone carrier 36 is equal to the tangent of the angle of the inter engaged ramps 40 and 46. At thirty degrees, the proportion is approximately 0.57. Obviously, a less acute angle would wedge more, and forty five degrees would be one to one. Still, the sharper angles act with less resistance, and thirty degrees has been found adequate. Likewise, if the semi cylinders 50 are pushed down together, the engagement of the same slope ramps 40 and 52 has the same effect on the other pair of diametrically opposed stone carriers 36, which are similarly confined and guided. Conversely, if the core 44 is pulled axially up, its roll pins 48 ride in the pin slots 42 to rigorously pull the stone carriers 36 radially inwardly together, at the same ratio of axial to radial motion. By "rigorously", it is meant that the close fit of the pins 48 in the slots 42 acts without the lag or lost motion that would characterize a conventional garter spring. Likewise, simultaneous axial retraction of the semi cylinders 50 would act, through the roll pins 54, to rigorously retract the other pair of stone carriers 36, at the same ratio. The mechanisms that actually axially move the core 44 and the semi cylinders 50, and by the desired amount, are described next.

Referring next to FIGS. 1 and 3, it is useful to restate the significance of the central drive shaft 26. Its rotation not only provides the power for the honing operation per se, it also provides the power for the axial translation mechanism which, in turn, axially extends and retracts core 44 and semi-cylinders 50. In addition, the shaft 26 provides structural support and axial guidance for the various components of that axial translation mechanism. At the very center of drive shaft 26 is a long, central push rod 56, which is pierced at the upper end by a single, upper cross pin 58. Pin 58 runs closely, but slidably, through the upper clearance slots 60 in shaft 26, and pierces the walls of an upper bearing sleeve 62 that is axially slidable over the outer surface of shaft 26. Thus, shaft 26, rod 56 and sleeve 62 are all radially and rotationally constrained relative to one another by the close fit of upper cross pin 58, but rod 56 and sleeve 62 can slide axially relative to drive shaft 26 to the extent that pin 58 has axial clearance within upper clearance slot 60. Near the bottom of drive shaft 26, a cylindrical lower push sleeve 64 is closely received over rod 56 and within the inner wall of drive shaft 26. A pair of lower cross pins 66 through the upper end of lower push sleeve 64 runs closely and slidably through a two sided, lower clearance slot 68 in drive shaft 26, and also pierce the walls of a lower bearing sleeve 70. Therefore, lower push sleeve 64, bearing sleeve 70, and shaft 26 are similarly radially and rotationally constrained, but push sleeve 64 can slide axially inside of and relative to shaft 26 (and over rod 56) to the extent allowed by the lower clearance slots 68. The lower end of central push rod 56 is pinned to core 44, and the lower end of lower push sleeve 64 is pinned to both semi cylinders 50. Therefore, if rod 56 or lower push sleeve 64 are axially moved, so are the core 44 and both semi cylinders 50 (simultaneously) within tool guide 28. In addition, in the embodiment disclosed, a cylindrical upper push sleeve 72 is closely received within the upper part of drive shaft 26, and is a two piece structure, with a hollow lower sleeve that overlaps with push rod 56. Upper push sleeve 72 can slide within the inner wall of drive shaft 26, and over push rod 56, similar to lower push sleeve 64. The upper cross pin 58 also runs closely through clearance slots 74 in upper push sleeve 72, which match the drive shaft upper clearance slots 60 in size, so that the upper push sleeve 72 will not interfere with the axial sliding of rod 56 within drive shaft 26. The upper end of upper push sleeve 72 is fixed to the stub shaft 20, so as to be axially moved thereby, for a purpose described below. At any point in time, however, the upper push sleeve 72 may be practically considered to be an almost solid part of drive shaft 26, since it moves relative thereto only very gradually, as will be described below. The lower end of upper push sleeve 72 is fixed to a pair of central cross pins 75 that run closely but slidably through central clearance slots 76 in central drive shaft and which pierce the walls of a cylindrical cam sleeve 78 that closely surrounds the outer surface of drive shaft 26. Therefore, the cam sleeve 78 and upper push sleeve 72 are rotationally constrained relative to drive shaft 26, by both the upper cross pin 58 and the central cross pins 75, but are each capable of axial sliding relative to shaft 26 to the extent allowed by the upper clearance slots 60 and the central clearance slots 76. Again, however, at any point in time, the drive shaft 26, cam sleeve 78 and upper push sleeve 72 operate essentially as one solid part, with an axially fixed relation to one another, and the central clearance slots 74 need not be as long as the lower and upper clearance slots 60 and 68, since they accommodate a much smaller axial motion relative to drive shaft 26, as will be explained below.

Figure 9:
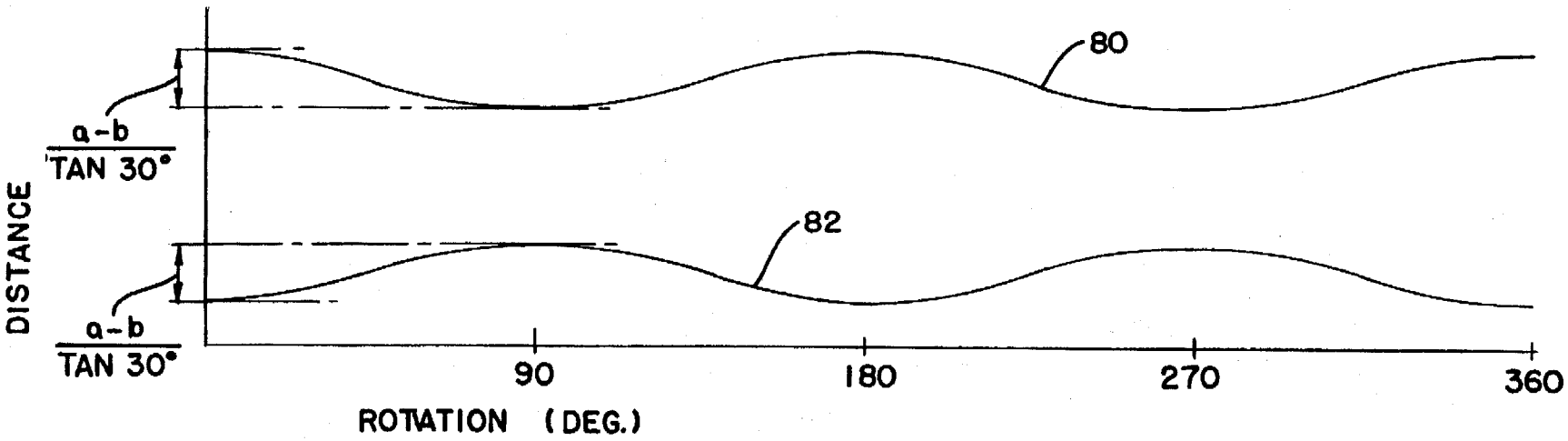
FIG. 9 is a schematic representation of the cam grooves.

Referring next to FIGS. 1, 3, 4 and 9, the mechanism that governs the translation of the rotation of drive shaft 26 into the proper degree axial motion of the push rod 56 and lower push sleeve 64 is described. The outer surface of cam sleeve 78 is machined with undulating, upper and lower cam grooves 80 and 82 respectively. Each groove 80 and 82 has an equal, constant radius, but an axial height, as measured parallel to the drive shaft 26 axis, that is constantly changing, from a highest point, to a lowest point, and back, over four ninety degree increments. Specifically, as best seen in FIG. 9, each groove 80 and 82 has four identical segments, each corresponding to a quadrant of the ellipse. The four stone carriers 36 are marked A–D in order to visually correlate to the grooves 80 and 82. The diametrically opposed pair of stone carriers A, C are the two that are operated by the core 44 (and push rod 56), and the other pair B, D are operated by the semi cylinders 50 (and lower push sleeve 64). The upper cam groove 80 has it's two highest points angularly aligned with the stones A and C, and its two lowest points aligned with the other two stones B and D. The converse is true for the lower cam groove 82, so that the two cam grooves 80 and 82 are continually either approaching or departing from one another, moving around the outside of cam sleeve 78. Between the high and low points, the axial depth of each groove 80 and 82 changes in proportion to the change in radius of a corresponding point on the ellipse that defines the inner surface of bore 24. For example, the upper groove 80, moving from the highest point over the next ninety degrees, descends to its lowest point, in line with stone carrier B. The total amount of axial descent over that ninety degrees is (a–b)/tan 30°. This is because the slope of the stone carrier ramps 40 is 30°, meaning that the cam groove 80 (or 82) must change depth proportionally more than one to one. If the ramps 40 had a 45° angle, then axial depth change would equal the radial change, since the tangent would be equal to one. At any point between the highest and lowest point, the depth change of the upper cam groove 80 (or the lower groove 82) is generalized as (R–b)/tan 30°. Again, R is calculated from the formula given above, for any angle θ. This calculation would be made at sufficiently small increments in angle to give the groove 80 (or 82) a smooth curve. The lower cam groove 82 moves in axial opposition to the upper groove 80 over the same 90 degrees, rising from its lowest point to its highest point, by the same differential. Each groove 80 and 82 then repeats the pattern over the following three quadrants. These formulae determine the shape of the grooves 80 and 82, and their relative location. The absolute location of the grooves 80 and 82 on cam sleeve 78 (and on drive shaft 26) is best understood after describing the structure that physically translates the changing axial height of the grooves 80 and 82 into the desired axial motion of the stone carriers 36.

Referring next to FIGS. 1 and 3, the physical connection between the upper cam groove 80 and push rod 56, and between the lower cam groove 82 lower push sleeve 64, are an upper cam follower, indicated generally at 84, and lower cam follower, indicated generally at 86. The lower cam follower 86 has a frame 88 that is clamped to the lower ends of a pair of guide rods 90, which border and parallel the drive shaft 26. The upper ends of the guide rods 90 slide freely through the honing machine cross brace 16 on suitable bearings 92. The upper cam follower 84 has a similar frame 94, but it slides freely over the guide rods 90, rather than being clamped thereto. The upper cam follower frame 94 has a pair of diametrically opposed rollers 96 fixed thereto, which ride 180 degrees apart in the upper cam groove 80. Similarly, the lower cam follower frame 88 has a pair of diametrically opposed rollers 98 that ride 180 degrees apart in the lower cam groove 82. Therefore, as the drive shaft 26 and cam sleeve 78 co rotate, the rollers 96, 98 are pushed up or down, depending on whether the grooves 80 and 82 are ascending or descending, and the cam followers 84, 86, which are prevented from rotating by the guide rods 90, are forced instead to slide axially up and down. Because of the relative orientation of the cam grooves 80 and 82, the cam follower 84 and 86 are continually pulled together, or pushed apart, relative to a reference frame carded by shaft 26. However, it must be recalled that the drive shaft 26 is also stroking axially up and down, so, relative to a grounded reference frame, the axial motion of the follower 84 and 86 is much more complex. However, it is the motion relative to the drive shaft 26 that is most significant. The final mechanical link in the connection is an upper ball bearing pack 100 that connects upper cam follower frame 94 to upper bearing sleeve 62, and a similar lower ball bearing pack 102 that connects lower cam follower frame 88 to lower bearing sleeve 70. The operation of the cam followers 84 and 86 is described next.

Referring next to FIGS. 1 and 3, the shape and orientation of the two cam grooves 80 and 82 relative to each other have already been described. As to the absolute location on shaft 26 of upper cam groove 80, it should be noted that wherever the upper cam follower rollers 96 axially reside relative to drive shaft 26 when they are at the high points of the upper cam groove 80 will determine the axial position of upper cam follower frame 94 (relative to drive shaft 26), which will determine the axial position of upper bearing sleeve 62 (through bearing pack 100), which will determine the axial position of rod 56 and core 44, and, thereby, the radial position of that diametrically opposed pair of stone carriers 36 labeled B and D. When the rollers 96 sit at the top of upper cam groove 80, then the rod 56 will be pulled up to its highest point, as will core 44, and the stones A and C will be retracted to their smallest effective radius. Therefore, in absolute terms, upper cam groove 80 has to be located on drive shaft 26 at an axial position which, when the upper cam rollers 96 are at the highest point, will retract the two stone carriers A and C enough to have a stone to stone separation of "2b", the shortest length of the two radius vectors R1 and R2 described above. The upper cam groove 80, of course, is actually located by fixing the cam sleeve 78 relative to the drive shaft 26, which, in turn, is done by pinning the cam sleeve 78 to the upper push sleeve 72 through the central cross pins 75. Where that actual location of upper cam groove 80 on drive shaft 26 will vary from case to case, depending on the length of push rod 56, the width of the upper cam follower frame 94, the relative widths of the stone carriers 36 and the core 44. But it can be empirically determined for any case. Likewise, the absolute location of the lower cam groove 82 on drive shaft 26 is determined such that, when the lower cam rollers 98 sit in the lowest points in the lower cam groove, then the remaining diametrically opposed pairs of stone carriers B and D will be radially extended to the greatest possible length of the radius vectors R1 and R2, or "2a". That absolute position will, in turn, depend upon the length of lower push sleeve 64, the width of the lower cam follower frame 88, the relative widths of the stone carriers 36 and the semi cylinders 50. But, as with the upper cam groove 80, it can be empirically determined in any case. When the cam grooves 80 and 82 are thereby absolutely located on the drive shaft 26, their relative angular location, shape, and depth profile, already described above, will create the proper expansion and contraction of the honing stone carriers 36, as is described next.

Before taming to a detailed description of the operation of apparatus 10, it is useful to recall that at the beginning of a typical honing cycle, it is necessary to retract all of the honing stones far enough to insert them easily into the bore, and then to expand them out against the surface of the bore, as described above. In honing a conventional round bore, that is the only radial motion that the stones undergo, apart from the steady, slow radial expansion that they undergo over length of the honing cycle for stock removal from the bore surface. Over any rotation per se, however, the honing stones in a conventional round bore honing tool all operate at the same, static radius. In the apparatus of the invention, the stones also initially retract and expand, and also undergo the slow steady expansion that conventional honing stones do. In addition, however, over every rotation, they retract and expand rapidly and dynamically, and are literally continually changing radius in order move in the proper elliptical path.

Figure 4:
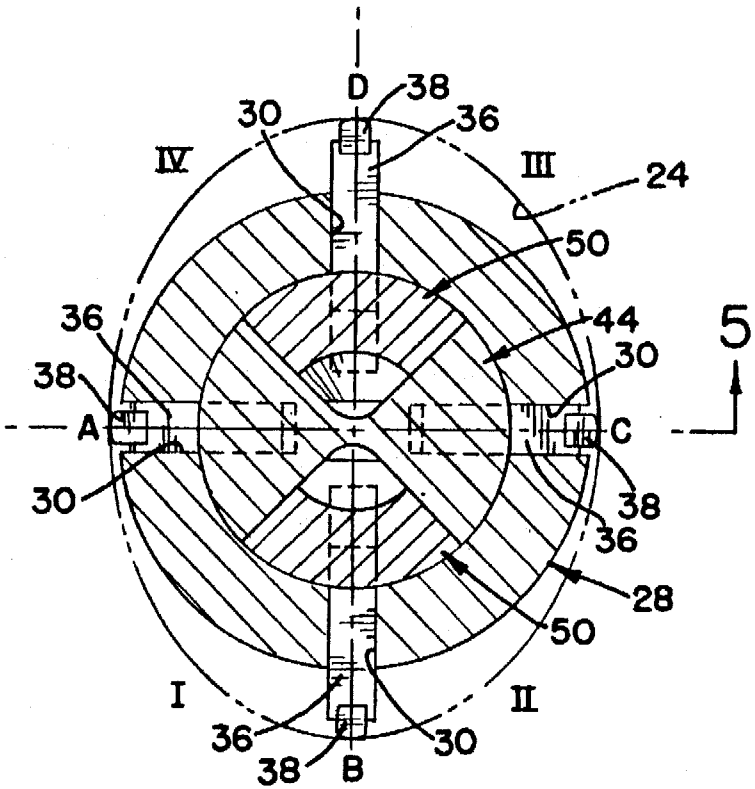
FIG. 4 is a sectional view taken along the line 4—4 of FIG. 3.

Referring next to the FIGS. 1, 3 and 4, at the beginning of the honing cycle, the upper and lower cam groove rollers 96 and 98 are at the position shown, with two of the stone carriers A and C retracted, the other two B and D expanded. If not, then drive shaft 26 and cam sleeve 78 can be slowly turned until they are. Then, the bore 24 to be honed and the stone guide 28 are mutually aligned until the retracted stone carriers A, C are aligned with the narrowest portion of the bore 24, and the expanded stone carriers B, D aligned with the widest portion. Next, while the spindle 18 and chive shaft 26 stay stationary, the honing machine stub shaft 20 is retracted through the spindle 12, thereby pulling the cam sleeve 78 up on drive shaft 26 from its normal location, as the central cross pins 75 shift through the central clearance slots 76 in drive shaft 26. This causes the cam sleeve 78 to pull up on both rollers 96 and 98, which do move axially up relative to the drive shaft 26, but do not move within the cam sleeve grooves 80 and 82. Concurrently, the rollers 96 and 98 pull up on both cam follower frames 94 and 88, on both bearing packs 100 and 102, on both bearing sleeves 62 and 70, and ultimately on both the central push rod 56 and the lower push sleeve 64, which slide relatively through the stationary drive shaft 26. The clearance slots 60 and 68 accommodate this sliding. This causes both the central core 44 and the semi cylinder 50 to be pulled up simultaneously and equally, and thereby retract all four stone carriers 36, even the two (A and C) that were already retracted to their normally minimum radius. Then, the spindle 18 and drive shaft 26 are extended far enough to insert the stone guide 28 into the bore 24. All of the stones 40 will be retracted enough to miss the edge of bore 24 Then, the stub shaft 20 and upper push sleeve 72 are extended axially sufficiently to expand all four stone carriers A–D radially out and into light contact with the rough machined inner surface of bore 24. Next, the machine 12 is activated to begin rotating and stroking spindle 18 and drive shaft 26 at the same speed and frequency noted above. Simultaneously, stub shaft 20 would begin its slow and steady axial extension within spindle 18 to cause a comparable axial progression of upper push sleeve 72 within drive shaft 26, to thereby cause a comparable axial downward relative sliding of cam sleeve 78 over the outside of drive shaft 26 (again, accommodated by the central clearance slots 76). However, this is such a slow and slight axial progression that at any point in time, and for any given rotation or two of drive shaft 26, cam sleeve 78 can be considered to have a fixed axial position on and relative to drive shaft 26.

Referring next to the Figures, what the stone carriers 36 do over any given rotation may be described. A convenient starting point is the same position described above for FIG. 3, with the upper and lower rollers 96 and 98 located at the high and low points of the cam grooves 80 and 82 respectively. As the drive shaft 26 begins to rotate, the cam sleeve 78 rotates with it, because of the central cross pins 75. The cam sleeve 78 also maintains a basically fixed axial position relative to drive shaft 26, because of the fact that the upper push sleeve 72 (to which the central cross pins 75 are fixed) also maintains a basically fixed axial position relative to shaft 26, even though it is stroking up and down with it relative to ground. Because cam sleeve 78 is solidly fixed to drive shaft 26, rotation of drive shaft 26 causes the rotationally constrained rollers 96 and 98 to roll through the relatively rotating cam grooves 80 and 82. Specifically, over the first quarter turn of cam sleeve 78, upper rollers 96 roll down to the lowest point in upper cam groove 80, and lower rollers 98 roll up to the highest point in lower cam groove 82, moving to the FIG. 6 position. This pulls the upper and lower cam follower frames 94 and 88 relatively toward one another, with upper frame 94 moving down and lower frame 88 moving up, relative to drive shaft 26. Relative to ground, of course, either or both frames 88 and 94 may be moving up or down along with the stroking drive shaft 26. As the upper cam follower frame 94 moves down relative to shaft 26, the two stone carriers labeled A and C rotate one to one with stone guide 28 (and drive shaft 26), moving along the quadrants of the bore 24 labeled I and III. At the same time, the stone carriers A and C, starting from their most retracted position, expand radially. This is because the central push rod 56 is pushing core 44 down within stone guide 28, which wedges the stone carriers A and C equally apart as their ramps 40 are pushed out by the core ramps 46. Because of the mathematical relationship between the depth change of the upper cam groove 80, (over the first 90 degrees), the angle (and tangent value) of the ramps 40, and the shape of the bore 24, the stones 38 on the stone carriers A and C rigorously track the points of the radius vector R1, and run accurately along the proper elliptical path in the diametrically opposed quadrants I and III, regardless of how accurately the bore 24 was initially cut.

Simultaneously, over the first quarter turn of cam sleeve 78, lower cam roller 98 moves up to the high point of lower cam groove 82, and the semi-cylinders 50 are pulled up within stone guide 28, to the same extent that the central rod 56 and core 44 were pushed down. The other two diametrically opposed stone carriers B and D are therefore pulled from their most expanded position simultaneously radially inwardly by the roll pins 54 riding in the pin slots 42. Therefore, the stones 38 on the stone carriers B and D track the endpoints of the radius vector R2, and accurately follow the shape of the other two diametrically opposed ellipse quadrants II and IV. Rigorous accuracy is assured by the close fit of the roll pins 54 (and 48) in the stone carrier pin slots 42, which act without the lag or lost motion that would occur with conventional, resilient garter springs.

Figure 6:
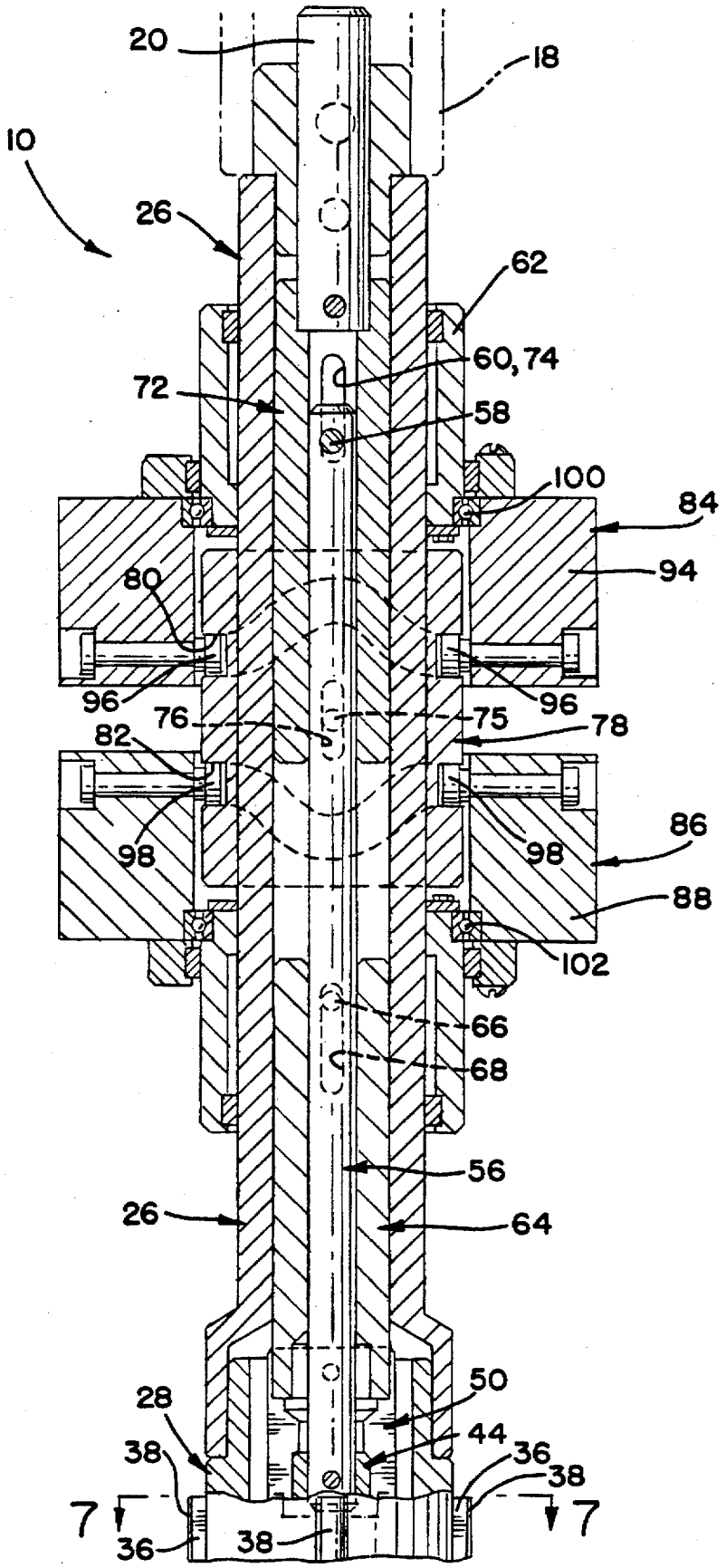
FIG. 6 is a view like FIG. 3, but showing the cam follower pulled together to their minimum separation.
Figure 8:
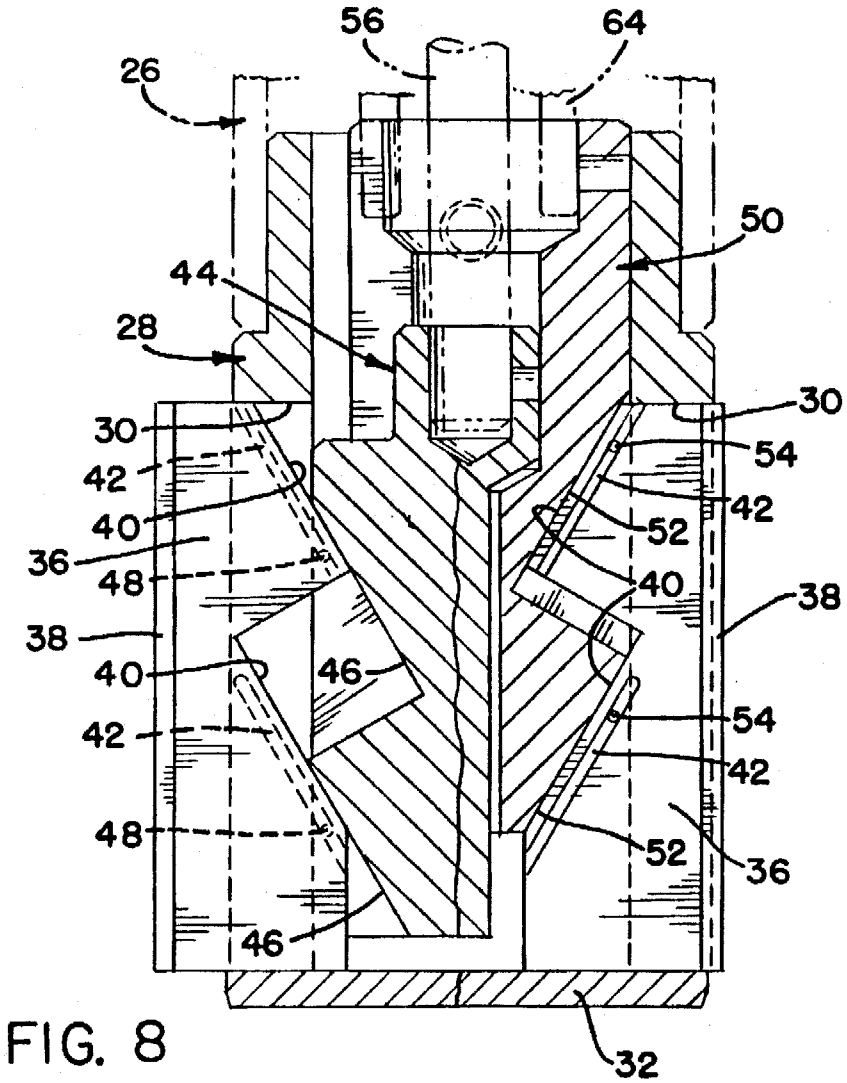
FIG. 8 is a sectional view taken along the line 8—8 of FIG. 7.
Figure 7:
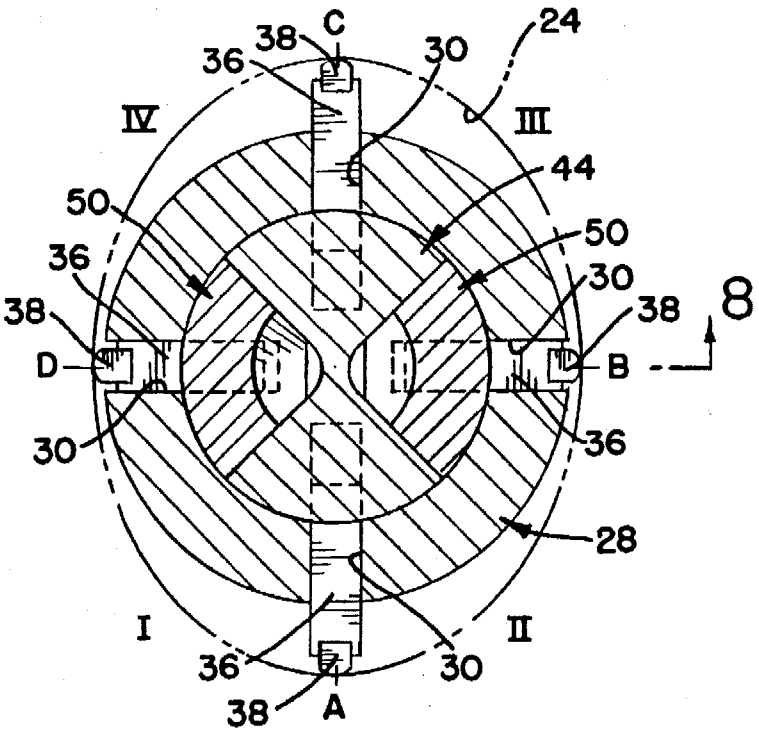
FIG. 7 is a sectional view taken along the line 7—7 of FIG. 6.

During the next quarter turn of cam sleeve 78, the converse action occurs, moving back from the FIG. 6 to the FIG. 3 position. The upper rollers 96 roll back up, and the lower rollers 98 roll back down to their previous level. The stone carriers A and C then retract as the core roll pins 48 slide in the pin slots 42, following the quadrants II and IV, as the stone carriers B and D are wedged back apart by semi cylinder ramps 52 to follow the quadrants I and III. The situation repeats with every half ram of cam sleeve 78 and drive shaft 26, so the elliptical shape is accurately and rigorously cut, not just passively followed. The rapid, twice with every rotation, axially opposed oscillation of the cam follower frames 94 and 88 is guided and supported by the guide rods 90. The concurrent and equally rapid oscillation of the central push rod 56 and the lower push sleeve 64 within drive shaft 26 are guided and accommodated by the close fit and axial clearance between the upper and lower cross pins 58 and 66 and the respective upper and lower clearance slots 60 and 68. In addition, the mutually rubbing surfaces of central push rod 56, lower push sleeve 64, drive shaft 26, and upper push sleeve 72 are suitably lubricated.

Referring again to FIGS. 1 and 3, in addition to the rapid, back and forth oscillation of the parts just described, the upper push sleeve 72 is being steadily and slowly axially advanced within and relative to drive shaft 26. The total increment of axial advance is small, only that which is necessary to radially expand the honing stones 38 by approximately a thousandth of an inch, and the rate of advance is slow, since it occurs over the entire honing cycle of the bore 24. Small as it is, the progression of push sleeve 72 pushes the cam sleeve 78 an equal amount relative to and over the outside of drive shaft 26 (acting through the central cross pins 75 that pierce the cam sleeve 78). The relative axial advance of cam sleeve 78, in turn lowers both the upper and lower limits of the cam grooves 80 and 82. This has the effect of increasing the radius at which the stones 38 work at every point in the cycle, meaning that the maximum radius, minimum radius, and every radius in between is increased by the same slight amount, but still following a concentric elliptical track. This has the effect of steadily increasing the thickness of material honed off of the inner surface of bore 24, independently of, and without interfering with, the rapid expansion and contraction that all of the stone carriers 36 are continually undergoing over every rotation of drive shaft 26. At the end of the cycle, all stones 38 are retracted and removed from bore 24. It can be seen, therefore, that the cam sleeve 78 provides, directly or indirectly, several different functions, including providing an accurate elliptical shape, initial stone retraction and expansion at the beginning of the cycle, and stock removal during the cycle. None of the operational advantages of a conventional, round bore honing machine are lost, yet an elliptical shape is actively created and improved by the apparatus 10, rather than simply being passively followed and worsened, as with known elliptical honing tools.

Variations in the disclosed embodiment could be made. Most fundamentally, a single active cutting member, such as a stone carrier 36, could be used, which would retracted and expanded by the same type of wedging mechanism and cam sleeve so as to follow the same ellipse (or to follow any other closed curve capable of being similarly mathematically translated). However, an apparatus with at least a pair of diametrically opposed active tool surfaces, and preferably two pairs, is much faster acting and better balanced. The basic theory of translating an axial depth change of a constant radius, rotating cam surface at right angles and into a changing radius of a tool that tracks an ellipse (or any other closed curve) is the same. Mechanical means other than the ramps disclosed may be imagined to translate the axial shifting into proportionate (or even one to one) radial shifting, but the slidable ramps, pins and slots disclosed are simple and effective. If independent means were provided for retracting and expanding the honing stone carriers 36 at the start of a cycle, then the cam sleeve 78 would not have to be axially movable over the outside of the drive shaft, and could be a solid, even integral part thereof. If the cam sleeve 78 were solid, of course, then to achieve progressive stock removal over the honing cycle, some other means would have to be provided for steadily increasing the axial depth to which the push rod 56 and lower push sleeve 64 pushed the core 44 and semi cylinders 50. If stock removal during each cycle were not needed, for some reason, then the upper push sleeve 72 would not necessarily be needed, either, although it could still be used, in conjunction with the axially slidable cam sleeve 78, to effect the retraction and expansion of the honing stone carriers 36. Therefore, it will be understood that it is not intended to limit the invention to just the embodiment disclosed.

We claim:

1. An apparatus for machining the surface of an axial bore in a workpiece, which surface, in a cross section taken normal to its central axis, comprises a closed curve with a central origin lying on the bore axis and which can be described mathematically in terms of the incremental change of length of, per incremental change in angle of, a radius vector sweeping about the same origin and axis and having a least length corresponding to a predetermined reference angle, said apparatus comprising, in combination, a central drive shaft rotatable about said central axis, a right angle translation mechanism to translate linear motion along said axis into a predetermined proportion of linear motion along said radius vector, a continuous cam surface rotatable with said drive shaft having a constant radius relative to said central axis but an axial height that changes, relative to a greatest height that corresponds to said reference angle, by an incremental amount that is proportionally equivalent to the length change of said radius vector at corresponding angular increments, an axially slidable linear translation mechanism that tracks said cam surface as said drive shaft rotates and translates the axial height change of said cam surface continuously to said right angle translation mechanism, a machining tool that is operatively joined to said right angle translation mechanism so as to rigorously track said changing radius both as to angle and as to length increase and decrease as said right angle translation mechanism moves, and thereby machine said bore surface.

2. An apparatus for honing the surface of an axial bore in a workpiece, which surface, in a cross section taken normal to its central axis, comprises an ellipse centered on a central origin lying on the bore axis and which consists of four equal quadrants, each of which quadrants can be described mathematically in terms of the incremental change of length of, per incremental change in angle of, a pair of perpendicular radius vectors sweeping concurrently about the same origin and axis, each radius vector having a least length and a greatest length corresponding respectively to perpendicular semi minor and semi major axes respectively of said ellipse, said apparatus comprising in combination, a cylindrical central drive shaft rotatable about said central axis, a generally cylindrical stone guide fixed to the end of said drive shaft so as to turn therewith, said stone guide having two pairs of diametrically opposed guide slots therethrough, each guide slot being parallel to said central axis, two independently actuatable pairs of diametrically opposed wedging members within said stone guide, each wedging member having an outwardly directed ramp thereon of predetermined angle, each of said wedging members being radially constrained within said stone guide, but axially slidable up or down so as to move said ramps in alignment with and parallel to a respective guide slot in said stone guide, four independently actuatable honing stone carriers, each axially and rotationally constrained, but radially slidable through, a respective guide slot in said stone guide, each stone carrier having a fixed inwardly directed ramp thereon of equal angle operatively engaged with the outwardly directed ramp of a respective wedging member so as to be rigorously radially extended or retracted thereby as said wedging member is respectively moved axially down or up to a degree determined by the angle of said ramps, each stone carrier also having a honing stone fixed thereto and located radially outboard of said guide slot, a central push rod slidable up and down coaxially within said cylindrical drive shaft, but rotationally constrained so as to turn therewith one to one, said central push rod having a lower end fixed to one diametrically opposed pair of said wedging members, a push sleeve surrounding said push rod slidable up and down independently of said push rod coaxially within said central drive shaft, and also rotationally constrained so as to turn therewith one to one, said push sleeve having a lower end being fixed to the other diametrically opposed pair of wedging members, a cylindrical cam sleeve surrounding, and rotationally and axially fixed relative to, the outside of said central drive shaft, an upper cam groove in the outer surface of said cam sleeve with an axial height that changes, over each ninety degrees of rotation, by an incremental amount that is proportionally equivalent to the length change of one of said radius vectors at corresponding angular increments within two diametrically opposed quadrants of said ellipse, a lower cam groove in the outer surface of said cam sleeve with an axial height that changes, over each ninety degrees of rotation, by an incremental amount that is proportionally equivalent to the length change of the other of said radius vectors at corresponding angular increments within the other two diametrically opposed quadrants of said ellipse, a first axially slidable linear translation mechanism that tracks said upper cam groove as said drive shaft rotates and translates the axial height change of said upper cam groove continuously to one of said central push rod and push sleeve, a second axially slidable linear translation mechanism that tracks said lower cam groove as said drive shaft rotates and translates the axial height change of said lower cam groove continuously to the other of said central push rod and push sleeve, whereby said diametrically opposed pairs of honing stones continuously track said radius vectors as said drive shaft rotates, thereby accurately honing said elliptical bore.

3. An apparatus for machining the surface of an axial bore in a workpiece, which surface, in a cross section taken normal to its central axis, comprises a closed curve with a central origin lying on the bore axis and which can be described mathematically in terms of the incremental change of length of, per incremental change in angle of, a radius vector sweeping about the same origin and axis and having a least length corresponding to a predetermined reference angle, said apparatus comprising, in combination, a central drive shaft rotatable about said central axis, a right angle translation mechanism to translate linear motion along said axis into a predetermined proportion of linear motion along said radius vector, a cam member adapted to rotate with said drive shaft one to one and to slide steadily and slowly axially relative to said central drive shaft over a fixed cycle time, but to be held substantially axially fixed relative to said central drive shaft at any point in time, a continuous cam surface on said cam member having a constant radius relative to said central axis but an axial height that changes, relative to a greatest height that corresponds to said reference angle, by an incremental amount that is proportionally equivalent to the length change of said radius vector at corresponding angular increments, an axially slidable linear translation mechanism that tracks said cam surface as said drive shaft rotates and translates the axial height change of said cam surface continuously to said right angle translation mechanism, a machining tool that is operatively joined to said right angle translation mechanism so as to rigorously track said changing radius both as to angle and as to length increase and decrease as said right angle translation mechanism moves, and thereby machine said bore surface.

* * * * *